US005573364A

United States Patent [19]

Schneider et al.

[11] Patent Number: 5,573,364

[45] Date of Patent: Nov. 12, 1996

[54] AUTOMATED PARKING SYSTEM FOR MOTOR VEHICLES

[75] Inventors: Volker R. Schneider, Siegen; Karl Schepp, Kreuztal; Hans-Peter Kobelitz, Cologne, all of Germany

[73] Assignee: Siemag Transplan GmbH, Netphen, Germany

[21] Appl. No.: 338,067

[22] Filed: Nov. 14, 1994

[30] Foreign Application Priority Data

Nov. 12, 1993 [DE] Germany ..... 43 38 717.9

[51] Int. Cl.[6] ..... E04H 6/12

[52] U.S. Cl. ..... 414/234; 414/239; 414/264

[58] Field of Search ..... 414/233–4, 239–41, 414/253, 255–6, 259, 264, 286, 235, 242–6

[56] References Cited

U.S. PATENT DOCUMENTS

| | | | |
|---|---|---|---|
| 3,079,015 | 2/1963 | Sinclair et al. | 414/239 |
| 4,826,384 | 5/1989 | Okura et al. | 414/234 |
| 4,936,730 | 6/1990 | Morioka | 414/264 X |
| 4,976,580 | 12/1990 | Knakrick | 414/256 X |

FOREIGN PATENT DOCUMENTS

| | | | |
|---|---|---|---|
| 0551588 | 10/1956 | Belgium | 414/239 |
| 0277464 | 11/1987 | European Pat. Off. . | |
| 0505808 | 9/1992 | European Pat. Off. | 414/239 |
| 2622621 | 10/1987 | France . | |
| 2645572 | 10/1990 | France | 414/259 |
| 4142172 | 6/1993 | Germany | 414/234 |
| 0230869 | 9/1989 | Japan | 414/253 |
| 2167394 | 9/1985 | United Kingdom . | |
| 2183619 | 6/1987 | United Kingdom | 414/253 |

*Primary Examiner*—James W. Keenan

*Attorney, Agent, or Firm*—Anderson Kill Olick & Oshinsky, P.C.

[57] ABSTRACT

A parking system for a motor vehicle formed as a high-level rack storehouse including at least one rack-operating device for transporting a car, which is loaded on a pallet at a parking station, to one of a parking spot and an unparking station, and an arrangement for handling empty pallets and including a pallet-receiving device and a displaceable pallet-stacking device.

6 Claims, 7 Drawing Sheets

AUTOMATED PARKING SYSTEM FOR MOTOR VEHICLES

BACKGROUND OF THE INVENTION

The present invention relates to a parking system for use in a parking garage, built as a high-level rack storehouse and including a rack-operating device for transporting a pallet supporting a vehicle from a parking station to a parking location and, therefrom, to an unparking station.

A parking system for use in a parking garage built as a high-level rack storehouse and including a rack-operating device for transporting a pallet, together with a vehicle supported thereon, between different locations, is generally known.

In the known parking system, the rack-operating device is also used for transporting empty pallets to a pallet-storing location. Using the rack-operating device for transporting empty pallets makes the rack-operating device not always available for transporting vehicles, and the efficiency of the parking system is substantially reduced (by about 50%), which is not acceptable. This reduces general acceptance of such parking systems because its use is accompanied by a long waiting time of garage users.

Accordingly, an object of the invention is a parking system having an improved parking and unparking efficiency.

SUMMARY OF THE INVENTION

This and other objects of the invention, which will become apparent hereinafter, are achieved by providing a parking system having an arrangement for handling empty pallets and including a pallet-receiving device and a pallet-stacking device which includes, preferably, an upward and downward displaceable lift table.

In the parking system according to the present invention, the operation of the empty pallet handling arrangement and of the rack-operating device are effected independently of each other, so that the rack-operating device becomes unnecessary for transporting the empty pallets, and is used exclusively for parking and unparking of the vehicles.

When the pallet-receiving device releases or takes up empty pallets during parking or unparking, respectively, the pallet-stacking device, on one hand, takes up or releases the pallets and, on the other hand, is ready for transporting a pallet stack to a buffer area or for transporting a pallet stack from a buffer area under the pallet-receiving device.

According to the invention, the pallet-receiving device advantageously comprises lateral pallet supports, which are displaceable relative to each other and which extend in a longitudinal direction of a vehicle.

By withdrawing pallet supports, which are arranged parallel to each other, a free space is created that provides for placing of an unloaded, empty pallet after a vehicle was removed therefrom, onto the lift table which is in its take-over position, or onto the uppermost pallet of a pallet stack removed from the lift table. When some of the pallet supports are being withdrawn, the remaining unloaded pallets rest on guiding plates which are provided, advantageously, on the pallet supports.

The guide plates also serve for removing the uppermost pallet from a pallet stack, located on the lift table, for using this pallet for parking a vehicle. As soon as the pallet supports start to move relative to each other, the guide plates move in a plane between the uppermost pallet and the pallet located immediately below the uppermost pallet until the upper pallet is located thereon. The lift table then lowers the stack, which had the uppermost pallet removed, and the pallet supports move together, with the removed pallet being ready for receiving a new-to-be-parked vehicle.

According to a preferred embodiment of the invention, there are provided linear drives for displacing the pallet supports and which insure their displacement to their predetermined positions.

According to the invention the pallet-stacking device includes means for securely retaining the stack during the transportation of the stack either to a buffer position, or to a pallet-removal position, or to a storage position.

According to another embodiment of the invention, the lift table is combined with a rotatable unit, advantageously, with a rotatable frame. This combination permits the user, in the case when the parking and unparking stations or boxes are located on one side of the parking garage lane, to unpark the vehicle, supported on a pallet lying on the rotatable frame, in the driving direction of the vehicle and not in a reverse direction. This increases the user's comfort with using the parking garage.

The lift table insures lifting of a pallet, with a vehicle supported thereon, from the pallet support to a height that insures an unhindered rotation of the pallet, together with the vehicle, by 180°. For enabling the rotation of the rotatable frame, it is provided with a toothed rack which is engageable with a driving pinion. After being rotated by 180°, the pallet is lowered again onto the pallet support and the user can drive the vehicle off the unparking station in a forward direction. After the vehicle leaves the pallet, it is again lifted and rotated by 180° to its initial position.

The pallet support of the pallet-receiving device move only relatively to each other, and the lift table deposits the pallet onto a pallet stack of the unparking station. Then, the pallet supports move together, and the unparking station is ready for a following unparking process.

BRIEF DESCRIPTION OF THE DRAWINGS

The features and objects of the present invention will become more apparent, and the invention itself will be best understood from the following detailed description of the preferred embodiment, when read with reference to the accompanying drawings, wherein.

DETAILED DESCRIPTION OF THE PREFERRED EMBODIMENT

Figure 1:
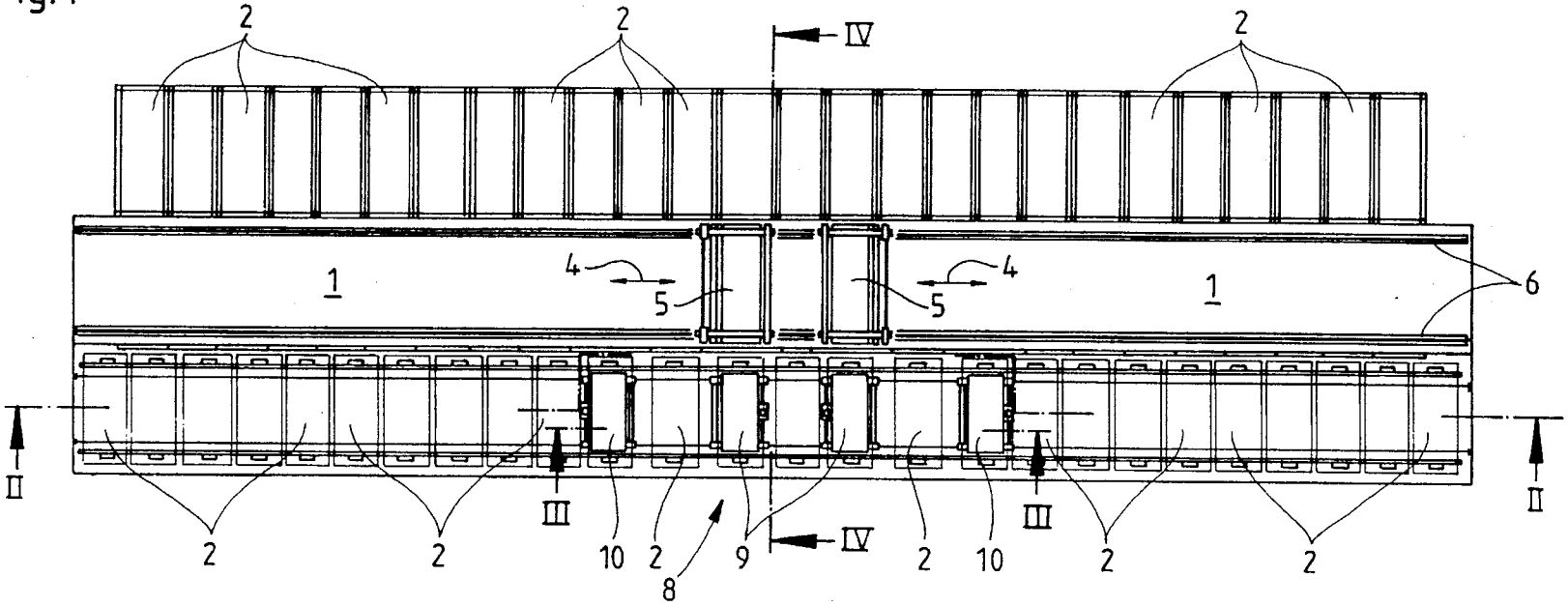
FIG. 1 is a top view of a ground floor of a multi-storey parking garage which is built as a high-level rack storehouse.

FIG. 1 shows a top view of a ground floor of a multi-storey parking garage, which is built as a high-level rack storehouse, with two rack-operating devices, which reciprocate in a lane, as well as a basic view of an empty pallet separate from the rack-operating device.

Figure 4:
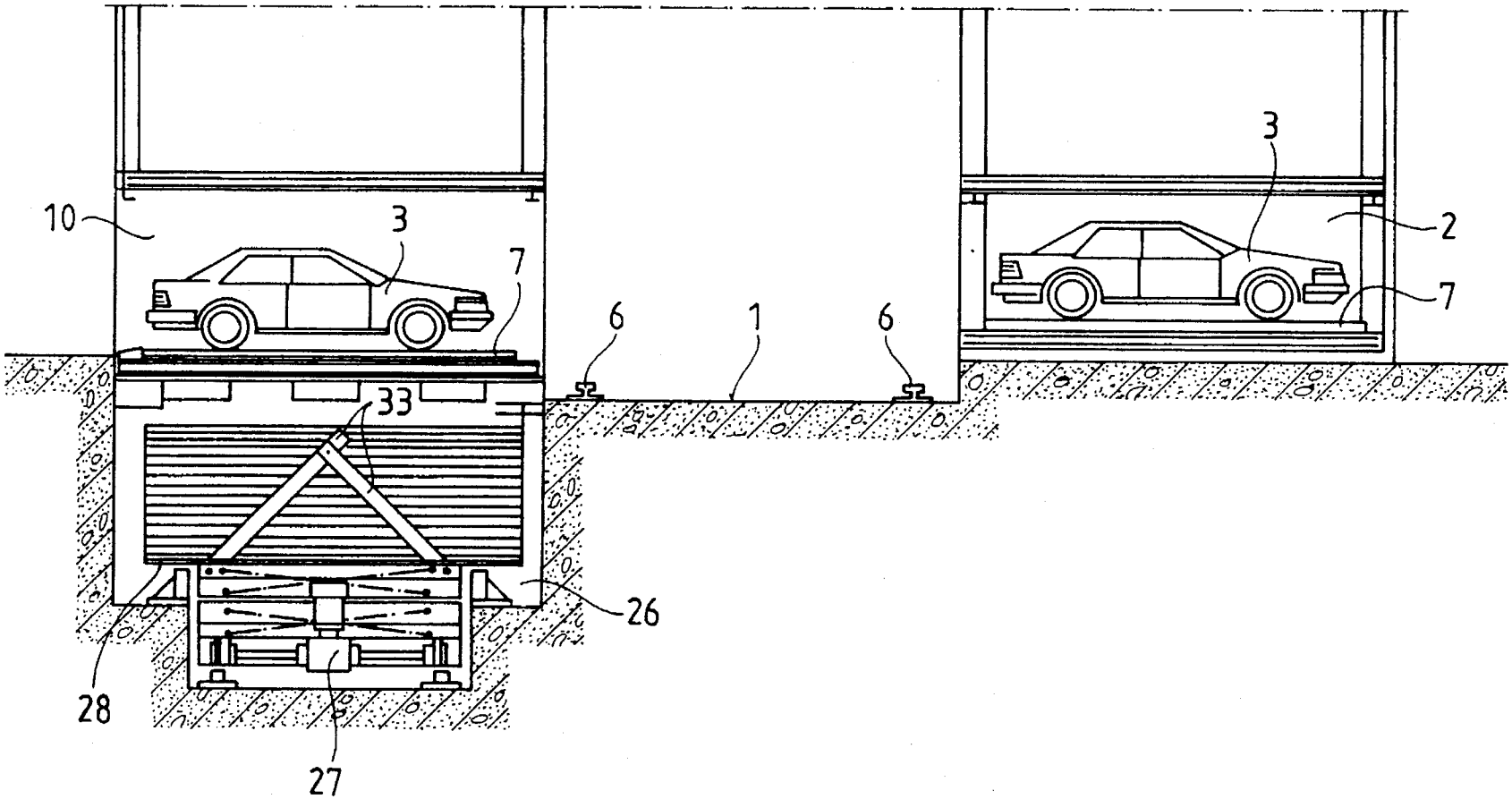
FIG. 4 is a cross-sectional view along line IV—IV in FIG. 1.

The parking garage, the ground floor of which is shown in FIG. 1, is formed of several storeys of a plurality of box-shaped parking spots 2 for passenger cars 3, and which are arranged on both sides of a lane 1. A view of a single parking spot 2 for a passenger vehicle or car 3 can be seen in FIG. 4. Two completely automatically controlled rack-operating devices 5, shown schematically, reciprocally move in the lane 1 in the direction of a double arrow 4.

Each of the rack-operating devices is equipped with an independently movable channeled vehicle for initiating the parking or unparking process of the rack-operating device, and which moves in a channel located beneath the parking spots to the left or to the right. The channeled vehicles of the rack-operating device 5, which are displaced on rails 6 and are arranged along the height of the multi-storey parking arrangement, provide for placing of the pallets 7, loaded with passenger cars 3, in respective parking spots, and for withdrawal of pallets with the passenger cars and transporting them to the unparking position.

Figure 3:
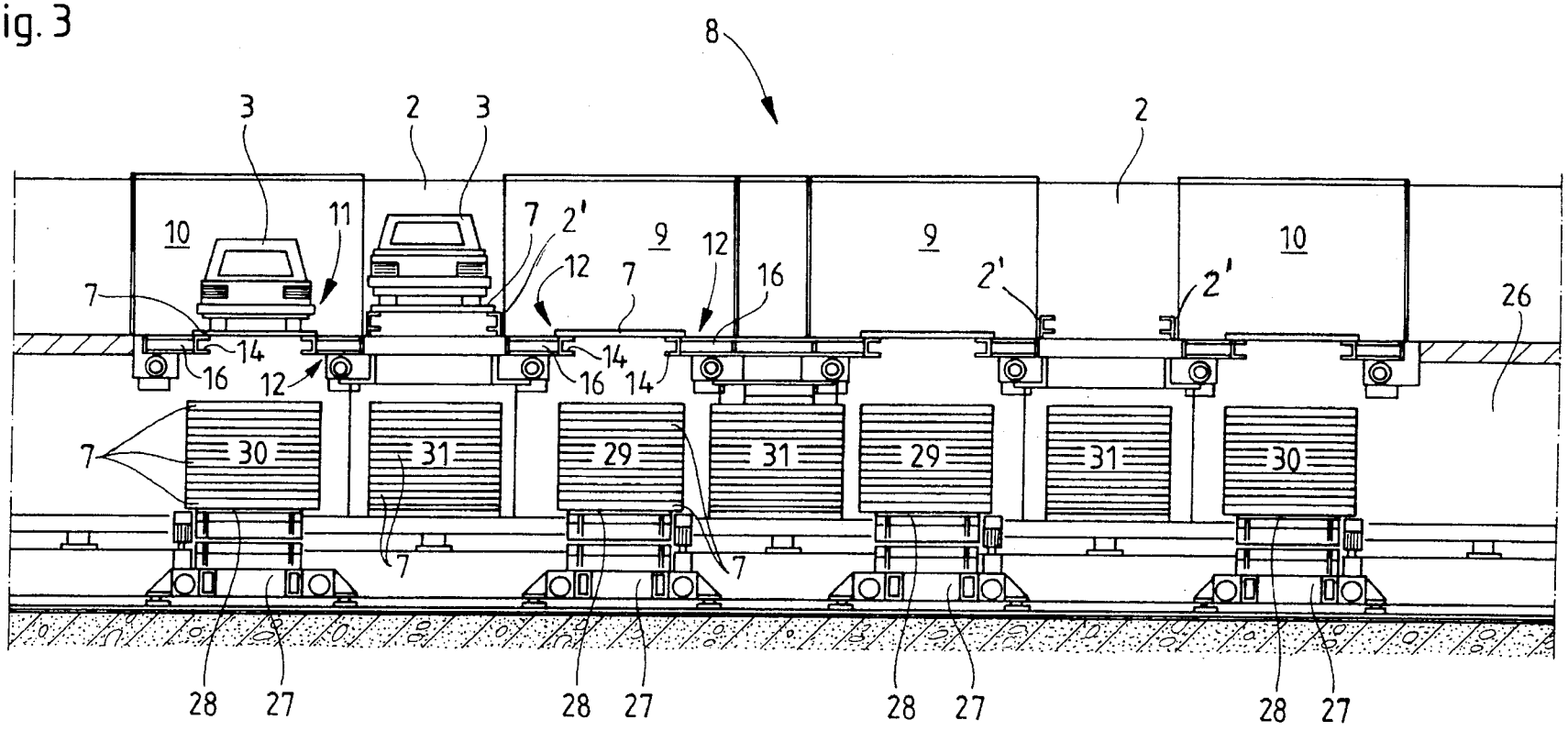
FIG. 3 is a cross-sectional view along line III—III in FIG. 1.

In the region of the parking garage entrance and exit 8, there are provided several driveways to parking boxes or stations 9, and unparking boxes or stations 10, which are more clearly shown in FIG. 3. The parking boxes 9 and the unparking boxes 10 include pallet-receiving devices 11 (shown in FIGS. 5 and 6) including each lateral pallet supports 12, which extend in the longitudinal direction of a passenger vehicle and are displaceable separately one above another. The pallet supports 12 are formed, as shown in more detail in FIGS. 5 and 6, essentially of a profiled, facing in a driving direction.

The wheels 16 move in base frames 17, which is reinforced with rectangular bars 18 arranged beneath the movable beams 13 and 14 and extending, when viewed in the longitudinal direction of a parked vehicle 3, between the opposite end sides of the pallet-receiving device 11.

Figure 5:
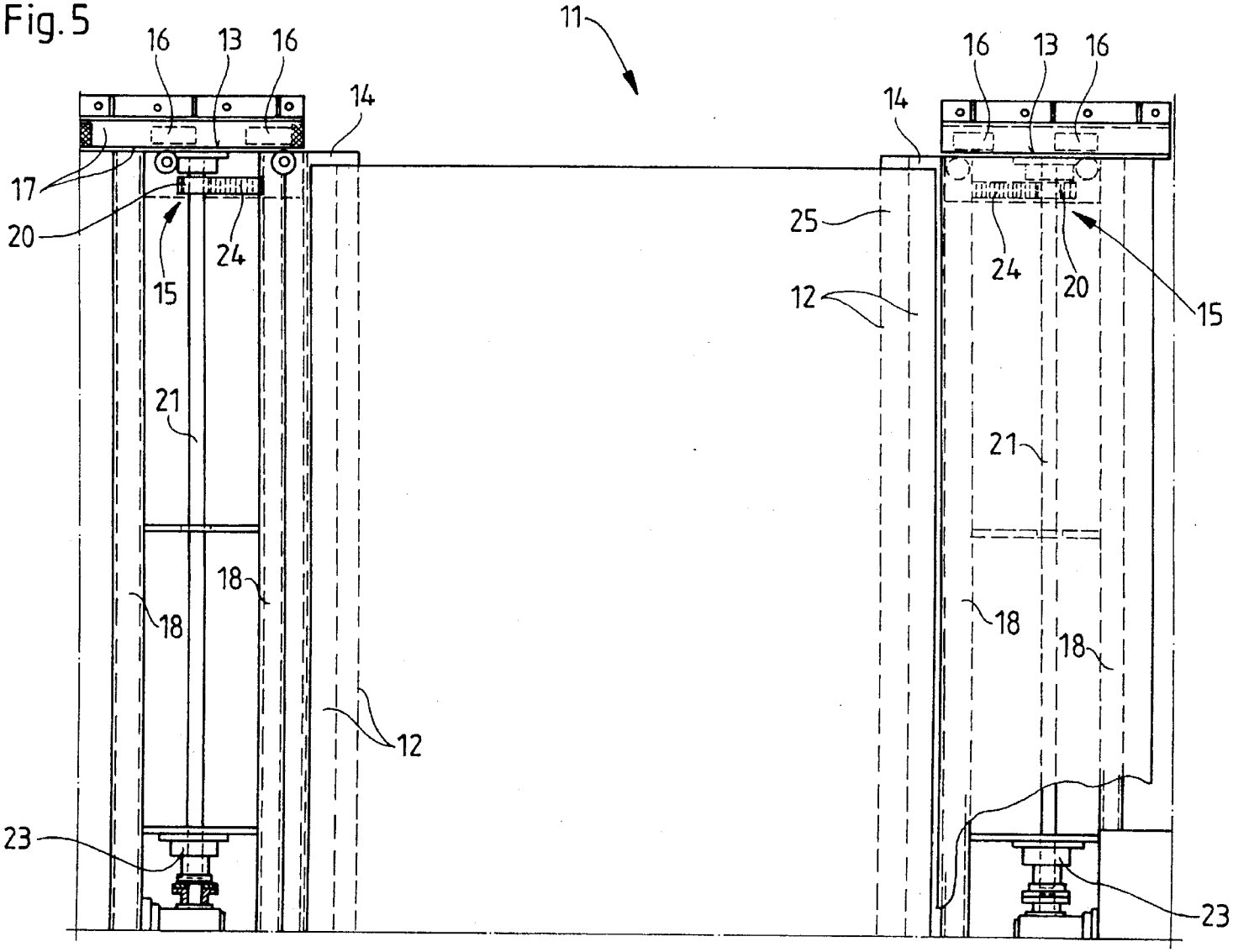
FIG. 5 is a top view of a symmetrical half of a pallet-receiving device having pallet supports movable one above the other separately from one another.

Each pallet support 12 is driven, for reciprocating the profiled beams 13 and 14, by a separable drive including a motor 19 having an output shaft 21 carrying a pinion 20. The drive is provided at a respective end face of the support. The shaft 21 is supported, at its end face, with flanges 22 which are connected with the rectangular beams 18. The shaft 21, because of its length, is formed of two portions with the two portions being connected by a step bearing 23, as shown in FIG. 5.

Figure 6:
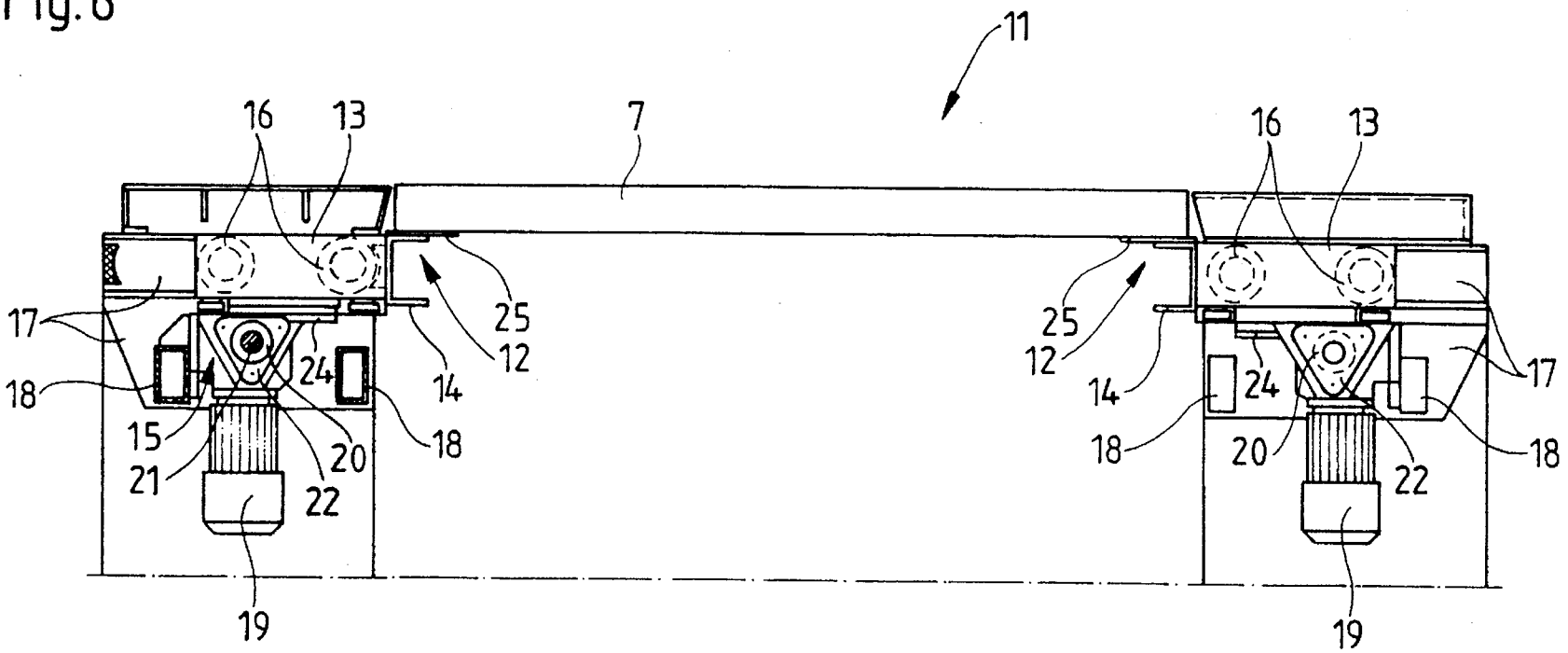
FIG. 6 is a side view of the pallet-receiving device shown in FIG. 5.

The pinion 20 engages a rack 24 of the linear drive 15. The pallet supports 12, i.e., their movable U-shaped profiled beams 14 are provided with guiding plates 25 on which a pallet 7 is supported (as shown in FIG. 6).

Beneath the parking and unparking boxes 9 and 10, a plurality of pallet-stacking devices 27 are arranged in an underfloor plane 26. The pallet-stacking devices 27 are formed either as a self-driven vehicle or a vehicle with an external drive and includes a lift table 28, on which a stack of pallets can be formed, with each pallet being withdrawn separately.

Figure 2:
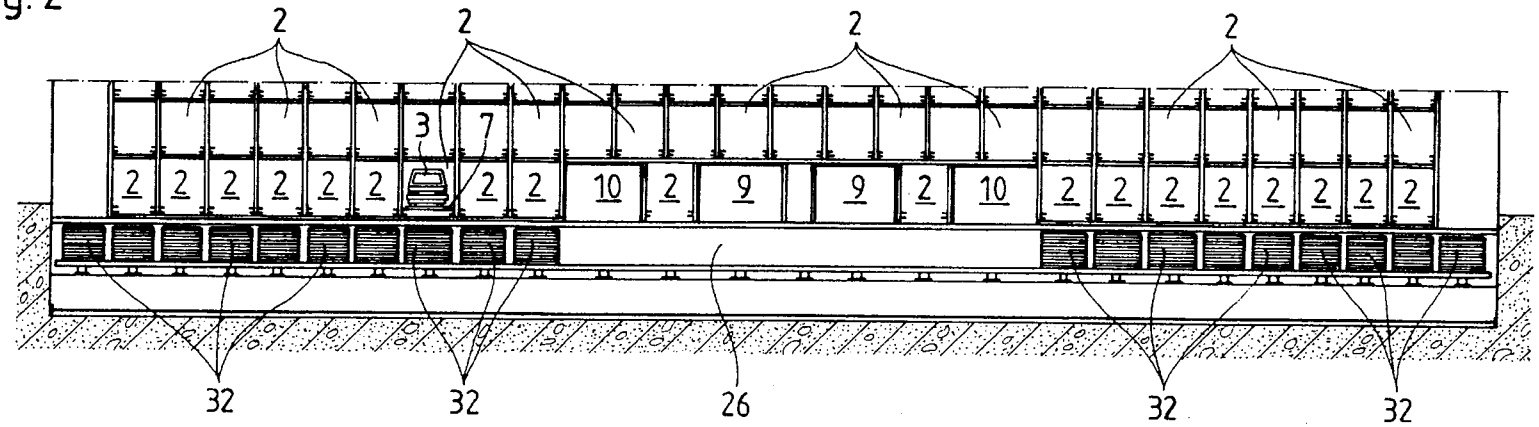
FIG. 2 is a cross-sectional view along line II—II in FIG. 1.

The pallet-stacking devices 27 provide for displacement of a pallet stack from an insertion position 29 or a withdrawal position 30 either to buffer spots 31 (FIG. 3) or to storage spots 32 (FIG. 2). Means is provided for securing the pallet stack during its transportation.

The securing means comprises a pivotal retaining element 33 (FIG. 4) provided on longitudinal sides of the pallet-stacking device 27. The pivotal element 33 is formed of two hingedly connected pivotal arms which are pivoted into their operational position by a lever system. The lever system is driven by an electrical or hydraulic linear motor.

A car 3 to be parked in a parking spot 2 enters a free parking box 9. Then, the car's occupant leaves the car, and the gate of the parking box 9 is closed.

For parking, the car 3 is received on a pallet 7 already provided in the parking box 9. The pallets 7 are provided in the parking boxes 9, as in the unparking boxes 10, in the following manner. In the initial position of the movable supports 12, in which the supports 12 are spaced far apart, the pallet-stacking device 27 lifts a pallet stack until the uppermost pallet is at the drive level of the box. In this position of the uppermost pallet of the stack, the motors 19 are activated in a direction such that oppositely located supports 12 move toward each other until the guiding plates 25 are located between the uppermost pallet and the pallet immediately beneath it (as shown in FIG. 6).

The remaining stack is then lowered by the lift table 28 of the pallet-receiving device 27. After the stack has been lowered, the motors 19 are again activated in the approaching direction of the pallet supports 12, which approach each other until the pallet 7, resting on the guide plates 25, rests not only on the guiding plates 25, but also on the profiled beam 14 of the pallet support 12, is shown for the parking box 9 in FIG. 3. In this position of the pallet 7, the parking box 9 is ready to receive a car. After car has been deposited in a respective parking spot 2, the motors 19 are activated in an opposite direction to move the supports 12 apart for receiving the next pallet 7.

When all of the pallets 7 are withdrawn from the stacking device 27, the stacking device 27 is displaced under a stack of pallets located at the buffer spot 31 or the storage spot 32, takes it up and transports it under the parking box 9. The filling of the parking position 29 or the buffer spot 31 with a new pallet stack, which is to be withdrawn from a storage spot 32, is effected by the stacking device 27 by withdrawing pallets from the externally located unparking boxes 10.

When a car 3 is placed on a pallet 7 as described above, one of the rack-operating devices 5 moves into a position aligned with the parking box 9 and in which the channeled vehicle of the rack-operating device 5 moves under the pallet 7 with the car and moves the pallet, together with the car, to a parking spot where the pallet 7, together with the car 3, is supported on opposite stationary beams 2, provided in the parking spot 2, as shown in FIG. 3. The rack-operating devices 5, which are used in the automated parking system according to the present invention are of a conventional type the operation of which is well known.

For unparking, a car 3 is transported by a rack-operating device 5 to one of two unparking boxes 10 from which it is moved by the channeled vehicle of the unparking box. After the user, together with the car, leaves the respective one of the parking boxes 10, the gate of the box is closed. The pallet supports 12 of the pallet-receiving device 11 are then spaced from each other a distance such, that the lift table 28 can lift the pallet stacking device 27, which is located beneath the box 10, and place it between the pallet Support 12, with the unloaded pallet 7, by that time being carried again only by the guiding plates 25 of the pallet supports 12.

As soon as the lift table 28 of the stacking device 27 is located in the take-over position, the pallet supports 12 are in a position in which they are at a maximum distance from each other. In this position of the pallet supports 12, the unloaded pallet 7 is placed on the lift table 28 or on the uppermost of the pallets stacked on the lift table 28. Thereafter, the lift table is lowered and the pallet supports 12 move to each other. The unparking box 10 is ready for receiving a new pallet on which a car has already been loaded. This process can be repeated as often as necessary for insertion of all of the pallets.

Finally, the rack-operating device is ready for receiving a load. To this end, the channeled craft of the rack-operating device 5 is moved under pallets, with the pallets being lifted off the unparking means of a respective parking spot and transported to their destination.

Figure 7:
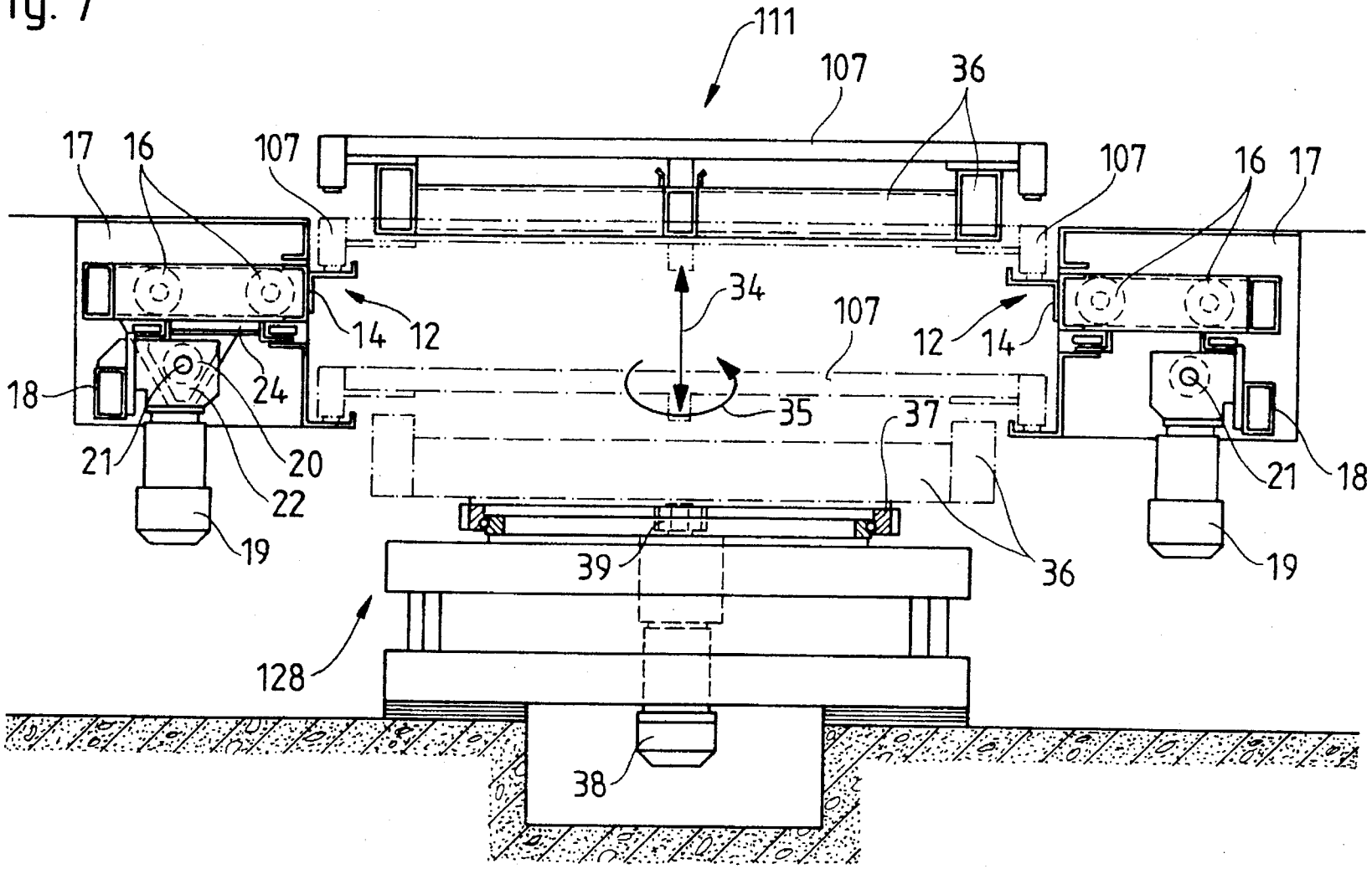
FIG. 7 is a side view of another embodiment of a pallet-receiving device than that shown in FIG. 5, with a lift table being provided with a rotary drive for a rotatable frame.
Figure 8:
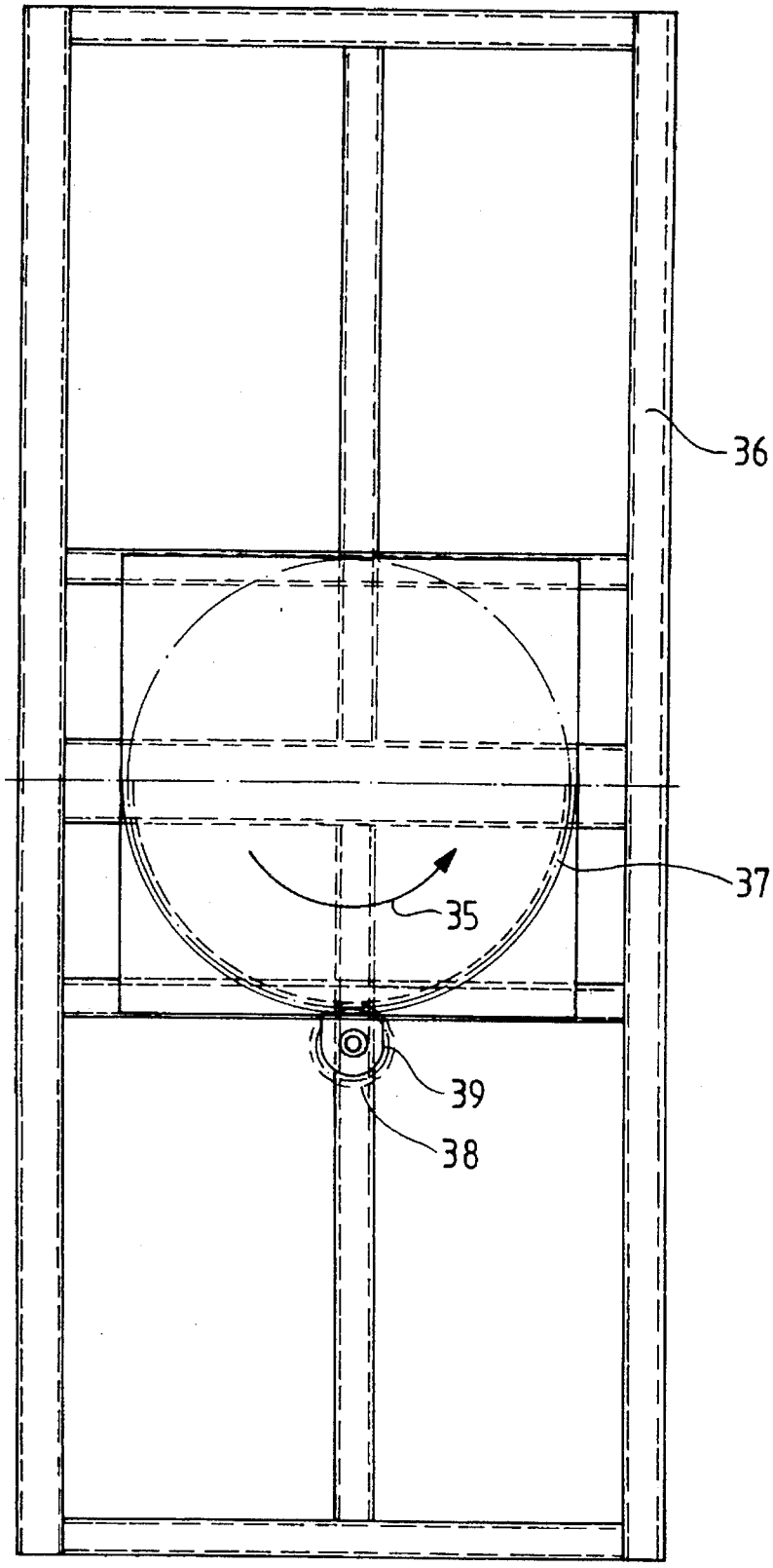
FIG. 8 is a top view of a rotatable frame, without a pallet, of a lift table, shown in FIG. 7.

The pallet-receiving device 111, shown in FIG. 7, represents a modification of that shown in FIG. 6, and structurally similar elements will be designated with the same reference numeral. In the arrangement of FIG. 7 the lift table 128 is not only displaceable in the direction of the double arrow 34, but is also equipped with a rotatable frame 36 (shown in FIG. 8) which rotates in the direction of arrow 35. When parking and unparking boxes 9 and 10 are located on one side of the rack lane 1, the rotatable frame 36 provides for parking and unparking of the vehicles facing in a driving direction.

After the loading means of the rack-operating device 5 or any other change-over craft moves a pallet 107 with a car thereon, shown in FIG. 7 with dash-dot lines, onto lateral pallet supports in the unparking box 10, the rotatable frame 36, likewise shown in FIG. 7 with dash-dot lines, lifts the pallet 107 from the pallet supports 12. In this position, the rotation of the pallet 107 by 180° becomes possible. To this end, the rotatable frame 36 is provided with a toothed crown 37 (FIG. 8) which is engaged by a pinion 39 driven by a motor 38. After being rotated by 180°, the pallet 107 is again placed on the pallet supports 12, and the car is the unparking box 10 is arranged facing a forward, driving direction.

For stacking empty pallets after they are lifted and rotated, if necessary, the supports are displaced from each other, as was already described, with reference to FIGS. 5 and 6, with the lifting table 107 subsequently lowering the pallets. As soon as the pallet supports 12 move toward each other, the unparking box 10 is available for the next unparking.

Though the invention was shown and described with reference to preferred embodiments, various modifications thereof will be apparent to those skilled in the art and, therefore, it is not intended that the invention be limited to the disclosed embodiments and/or details thereof, and departures may be made therefrom within the spirit and scope of the appended claims.

What is claimed is:

1. A parking system for motor vehicles, comprising:

a plurality of parking spots arranged as a multi-level rack storehouse;

at least one parking station comprising a parking box for receiving a motor vehicle to be transported to an empty one of the plurality of parking spots;

at least one unparking station comprising an unparking box for receiving a motor vehicle to be transported thereto from an occupied one of the plurality of parking spots for discharging same; and means for transporting motor vehicles from the parking box to the plurality of parking spots and from the plurality of parking spots to the unparking box; wherein the parking box and the unparking box each includes an arrangement for handling empty pallets on which the motor vehicles are received, each handling arrangement comprising a pallet-receiving device including two pallet supports extending in a longitudinal direction of a motor vehicle and means for moving the two pallet supports toward and away from each other in a direction transverse to the longitudinal direction, and a displaceable pallet-stacking device for delivering the empty pallets into the parking box and for removing the empty pallets from the unparking box, wherein the pallet stacking device comprises lift means, and wherein the lift means comprises a rotatable frame.

2. A parking system as set forth in claim 1, wherein the pallet supports are equipped with guiding plates.

3. A parking system as set forth in claim 1, further comprising linear drives for displacing the pallet supports.

4. A parking system as set forth in claim 1, wherein the lift means comprises a lift table.

5. A parking system as set forth in claim 1, wherein the rotatable frame has a toothed crown engageable with a driving pinion.

6. A parking system as set forth in claim 1, wherein the pallet stacking device comprises means for retaining a pallet stack.

* * * * *